US005329344A

United States Patent [19]

Gerbasi et al.

[11] Patent Number: 5,329,344

[45] Date of Patent: Jul. 12, 1994

[54] LUBRICATION OF A DETONING ROLL

[75] Inventors: Dennis G. Gerbasi; Bruce E. Thayer, both of Webster; Clark V. Lange, Ontario, all of N.Y.

[73] Assignee: Xerox Corporation, Stamford, Conn.

[21] Appl. No.: 143,705

[22] Filed: Nov. 1, 1993

[51] Int. Cl.[5] ..... G03G 21/00

[52] U.S. Cl. ..... 355/301; 15/256.5; 355/302

[58] Field of Search ..... 355/296, 298, 301-303; 118/652; 15/256.5

[56] References Cited

U.S. PATENT DOCUMENTS 4,494,863 1/1985 Laing ..... 355/302

*Primary Examiner*—A. T. Grimley
*Assistant Examiner*—William J. Royer
*Attorney, Agent, or Firm*—T. L. Fair

[57] ABSTRACT

A cleaning method and apparatus that provides lubrication to a secondary detoning roll in a cleaner brush system, thus reducing cleaning failures. The toner particles removed from the first detoning roll are transported to the second detoning roll. This allows lubrication of the second detoning roll and reduces the wear problem of the second detoning roll due to lack of lubrication.

26 Claims, 3 Drawing Sheets

LUBRICATION OF A DETONING ROLL

BACKGROUND OF THE INVENTION

This invention relates generally to an electrophotographic printing device, and more particularly, a lubricating system in the cleaner apparatus that lubricates a detoning roll.

In an electrophotographic application such as xerography, a charge retentive surface (e.g. photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g. paper), and the image affixed to form a permanent record of the image to be reproduced. Subsequent to development, excess toner left on the charge retentive surface is cleaned from the surface. The process is well known, and useful, for light lens copying from an original or printing applications from electronically generated or stored originals such as with a raster output scanner (ROS) where a charge surface may be imagewise discharged in a variety of ways. Ion projection devices, where a charge is imagewise deposited on a charge retentive substrate, operates similarly.

In a reproduction process of the type as described above, it is inevitable that some residual toner will remain on the photoconductor surface after the toner image has been transferred to the sheet of support material (e.g. paper). It has been found that with such a process the forces holding some of the toner particles to the imaging surface are stronger than the transfer force and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual debris remaining after image transfer.) The residual particles adhere firmly to the surface and must be removed prior to the next printing cycle to avoid it's interfering with recording a new latent image thereon.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. Toner particles adhere to the fibers (i.e. bristles) of the brush after the charge retentive surface has been cleaned. The process of removing toner from these types of cleaner brushes can be accomplished in many ways. A common method for providing detoning of these electrostatic brushes is the use of detoning rolls.

The particles removed from the brushes adhere to the detoning rolls and are then removed therefrom by scrapers. However, in this method a common problem is that the efficiency of the first detoning roll minimizes toner lubrication to the second detoning roll. This causes cleaning failures due to shorting of the brush bias to the detoning roll. A common compromise is made between performance and life, by slowing down the cleaner to reduce the wear rate and, shortening the scraper blade to reduce end wear of the detoning rolls.

The following disclosures may be relevant to various aspects of the present invention and may be briefly summarized as follows:

U.S. Pat. No. 4,494,863 to Laing discloses a toner removal device for removing residual toner and debris from a charge retentive surface after transfer of toner images from the surface. This device is characterized by the use of a pair of detoning rolls, one for removing toner from a biased cleaner brush and the other for removing debris such as paper fibers and Kaolin from the brush. The rolls are electrically biased so that one of them attracts toner from the brush while the other one attracts debris.

SUMMARY OF INVENTION

Briefly stated, and in accordance with one aspect of the present invention, there is provided a method for lubricating a second detoning roll, of a cleaning brush system, having a first and a second detoning roll, rotatingly engaged with a first brush and a second brush, respectively, the brushes being engaged with a surface, comprising: removing toner particles from the surface with the brushes; attracting the toner particles from the first brush with the first detoning roll; removing the toner particles from the first detoning roll; and moving said toner particles toward the second detoning roll to lubricate the second detoning roll.

Pursuant to another aspect of the present invention, there is provided a method for lubricating a second detoning roll, of a cleaning brush system, having a first and a second detoning roll, both rotatingly engaged with a brush and the brush being engaged with a surface, comprising: removing toner particles from the surface with the brush; attracting the toner particles from the brush with the first detoning roll; removing the toner particles from the first detoning roll; and moving the toner particles toward the second detoning roll to lubricate the second detoning roll.

Pursuant to another aspect of the present invention, there is provided an apparatus for cleaning toner particles from a moving surface, comprising: at least two brushes, a first brush and a second brush, each having a plurality of fibers extending outwardly therefrom; a housing, defining an open ended chamber, the brushes being mounted movably in the chamber of the housing with the fibers extending outwardly from the open end of the chamber of the housing in contact with the surface to remove the toner particles therefrom; means, a first detoning means and a second detoning means, for detoning, to remove the toner particles from the fibers removed from the surface; and means for removing the toner particles from the first detoning means toward the second detoning means.

Pursuant to another aspect of the present invention, there is provided an apparatus for cleaning toner particles from a moving surface, comprising: a brush, having a plurality of fibers extending outwardly therefrom; a housing, defining an open ended chamber, the brush being mounted movably in the chamber of the housing with the fibers extending outwardly from the open end of the chamber of the housing in contact with the surface to remove the toner particles therefrom; means, a first detoning means and a second detoning means, for detoning, to remove the toner particles from the fibers removed from the surface; and means for removing the toner particles from the first detoning means toward the second detoning means.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 2:
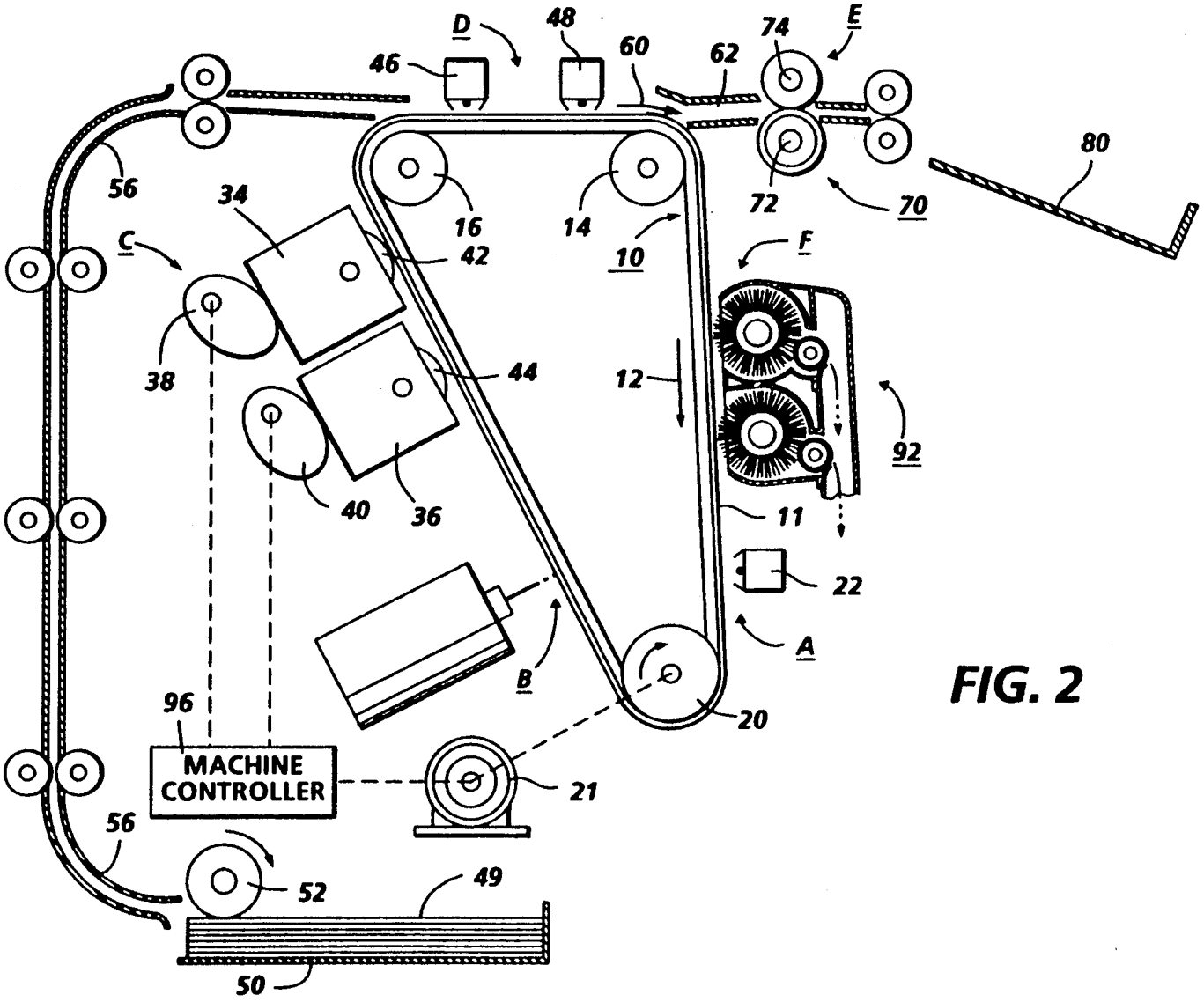
FIG. 2 is a schematic illustration of a printing apparatus incorporating the inventive features of the present invention.

For a general understanding of an electrophotographic printer or copier in which the present invention may be incorporated, reference is made to FIG. 2, which depicts schematically the various components, thereof. Hereinafter, like reference numerals will be employed throughout to designate identical elements. Although the direct drop lubricating detoning roll cleaner brush apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 2, will be described briefly hereinafter. It will no doubt be appreciated that the various processing elements also find advantageous use in electrophotographic printing applications from an electronically stored original, and with appropriate modifications, to an ion which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 2, initially a portion of the belt 10 passes through charging station A. At charging station A, a corona device 22 charges a portion of the photoreceptor belt 10 to a relatively high, substantially uniform potential, either positive or negative.

At exposure station B, a laser may be provided to imagewise discharge the photoreceptor in accordance with stored electronic information. Alternatively, an original document may be positioned face down on a transparent platen for illumination with flash lamps. Light rays are then reflected from the original document through a lens and projected onto a charged portion of the photoreceptor belt 10 to selectively dissipate the charge thereon. This would record an electrostatic latent image on the belt which corresponds to the informational area contained within the original document.

Thereafter, the belt 10 advances the electrostatic latent image to development station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The lubricating detoning roll cleaning apparatus of the present invention is represented by the reference numeral 92 which will be described in greater detail in FIG. 1. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

Figure 1:
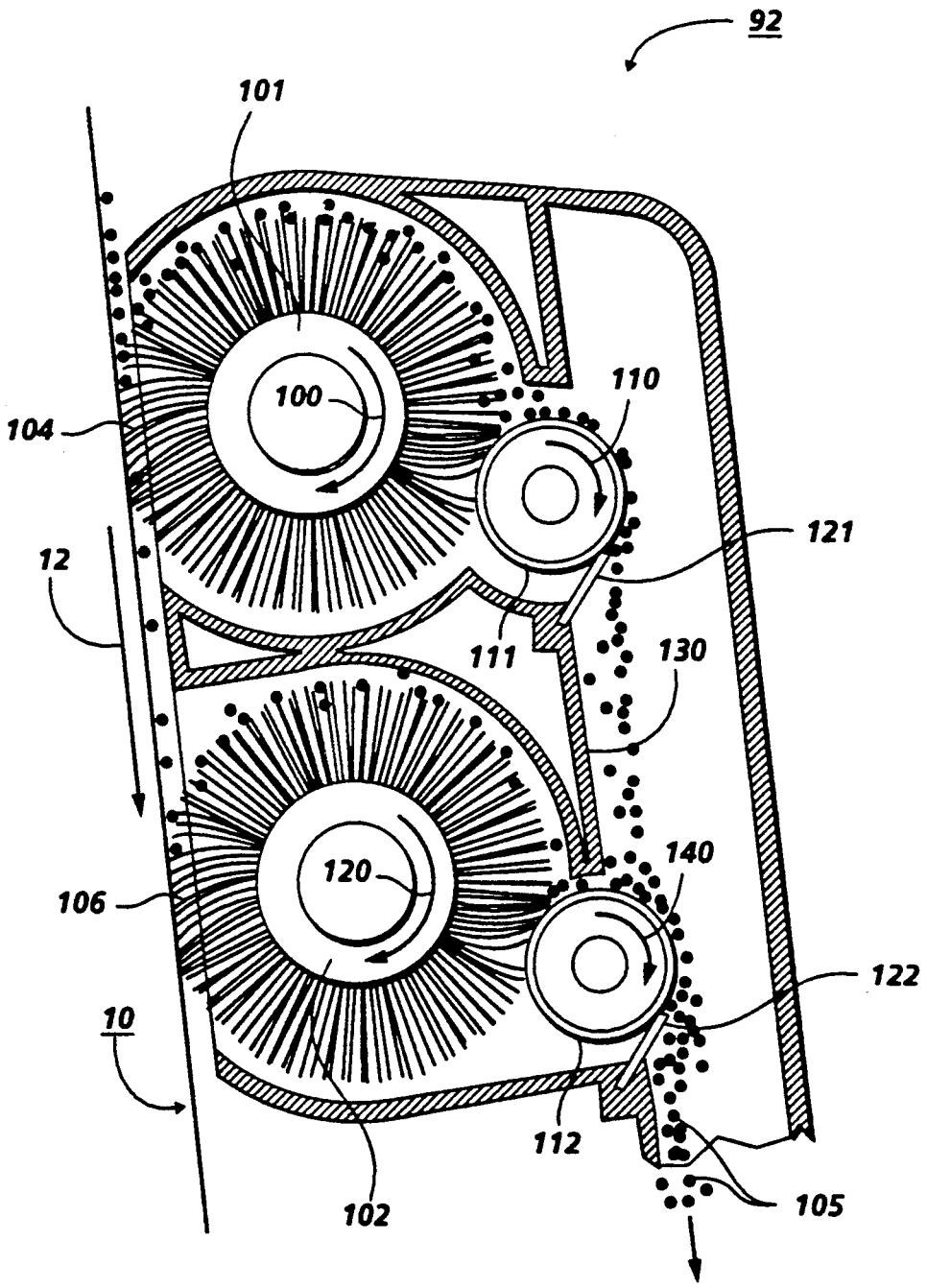
FIG. 1 is an elevational view of the present invention.

As thus described, a reproduction machine, in accordance with the present invention may be any of several well known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein. Reference is now made to FIG. 1, the showing is for the purpose of illustrating preferred embodiments of the present invention and not for limiting the same.

Referring now to FIG. 1, which shows a dual electrostatic brush cleaner incorporating the present invention in a vertical cleaner, where one brush 101 is located downstream from the second brush 102 in the direction of motion (indicated by arrow 12) of the photoreceptor belt 10. The toner particles 105 are removed from the photoreceptor 10 by the fibers of the brushes 101, 102. The cleaning brushes 101, 102 contact the photoreceptor 10 by the photoreceptor 10 to remove the toner particles 105 therefrom. The brushes 101, 102 rotate in the "with" direction of motion of the photoreceptor 10. The direction of rotation of the cleaner brushes 101, 102 is indicated by the arrows 100, 120.

Detoning rolls 111, 112 are used to remove the toner particles 105 picked up by the brush fibers 104, 106. The biased detoning rolls 111, 112 are located in adjacent proximity to the biased brushes 101, 102 to enable the detoning rolls 111, 112 to electrostatically remove the toner particles 105 from the brush fibers 104, 106. The detoning rolls 111, 112 rotate in the "with" direction of motion of their respective cleaner brushes 101, 102. The direction of rotation of the detoning rolls 111, 112 is indicated by the arrows 110, 140. The surface of the detoning rolls 111, 112 are cleaned of toner particles 105 by scraper blades 121, 122.

The first cleaning brush 101 of the dual electrostatic brush cleaner removes approximately 90% of the toner 105 from the photoreceptor 10 with the second brush 102 cleaning the remaining toner particles 105. Prior to the present invention, a wear problem normally occurred on the second detoning roll 112 that was not found on the first detoning roll 111 due to the unequal distribution of toner 105 between the first brush 101 and the second brush 102. The scraper blade 122 and the respective anodized aluminum detoning roll 112 would wear at a much faster rate due to this decreased lubrication. The anodized coating would wear until the coating was thin enough that pin holes would occur on the surface of the detoning roll leading to decreased detoning efficiencies. Increased use lead to cleaning failures due to shorting of the brush bias to detoning roll.

The present invention increases the reliability and life of a brush cleaner by reducing the failure level of the second detoning roll 112. This failure is due to a lack of toner lubrication between the second detoning roll 112 and the second scraper blade 122 which does not occur at the first detoning roll 111. The present invention uses the toner particles 105 cleaned from the first detoning roll 111, by the first scraper blade 121, on the second detoning roll 112. The toner particles 105 fall or are transported to the second detoning roll 112 thus, providing adequate lubrication for the second detoning roll 112. A baffle 130 is placed between the detoning rolls 111, 112 and the brushes 101, 102 to prevent the toner particles 105 removed from the first detoning roll 111 from falling onto the brushes 101, 102 in route to the second detoning roll 112 and to assist in guiding the toner particles 105 to the second detoning roll 112. The toner particles 105 removed from the second detoning roll 112 by the scraper 122 fall or are transported to a waste container (not shown).

With a vertical cleaner (as shown in FIG. 1), the toner 105 removed from the first detoning roll 111 can fall onto the second detoning roll 112 thus, providing adequate lubrication of the second detoning roll 112. A horizontal cleaner could use a paddle wheel to splash toner from the first detoning roll 111 onto the second detoning roll 112. This added lubrication from the first detoning roll 111 would resolve the problem of inadequate lubrication of the second detoning roll 112 without compromising cleaner performance.

Figure 3:
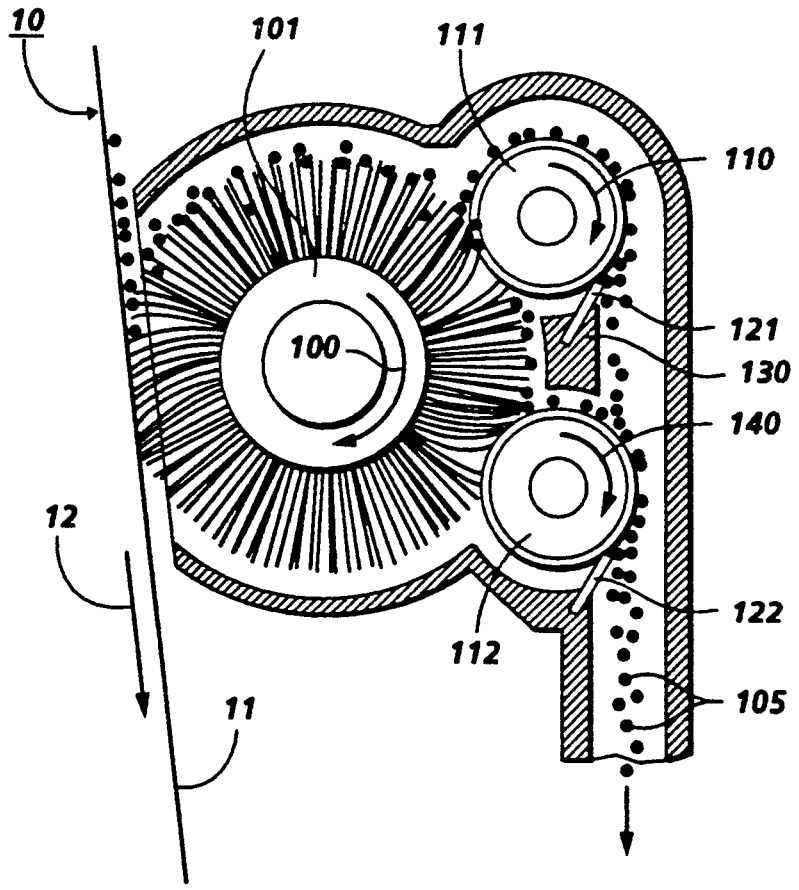
FIG. 3 is a schematic illustration of another embodiment of the present invention.

Another embodiment of the present invention, is the use of a single brush with two detoning rolls, as shown in FIG. 3. As is true in the above-mentioned embodiments, the first detoning roll is biased differently than the second detoning roll. A baffle is present between the two detoning rolls to guide the toner removed from the first detoning roll to the second detoning roll.

In recapitulation, the present invention consists of a dual electrostatic brush cleaning system that directs the toner particles removed from a first detoning roll to a second detoning roll. This lubricates the second detoning blade thus, decreasing wear problems. These wear problems, in turn caused decreased detoning efficiencies such as shorting of the brush bias to the detoning roll. The present invention resolves detoning deficiencies without compromising performance and life as other methods have.

It is, therefore, apparent that there has been provided in accordance with the present invention, a cleaning apparatus that lubricates a detoning roll that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for lubricating a second detoning roll, of a cleaning brush system, having a first and a second detoning roll, rotatingly engaged with a first brush and a second brush, respectively, the brushes being engaged with a surface, comprising:

removing toner particles from the surface with the brushes;

attracting said toner particles from the first brush with the first detoning roll;

removing said toner particles from the first detoning roll; and moving said toner particles toward the second detoning roll to lubricate the second detoning roll.

2. The method of claim 1, further comprising removing said toner particles from the second detoning roll.

3. A method for lubricating a second detoning roll, of a cleaning brush system, having a first and a second detoning roll, both rotatingly engaged with a brush, the brush being engaged with a surface, comprising:

removing toner particles from the surface with the brush;

attracting said toner particles from the brush with the first detoning roll;

removing said toner particles from the first detoning roll; and moving said toner particles toward the second detoning roll to lubricate the second detoning roll.

4. The method of claim 3, further comprising removing said toner particles from the second detoning roll.

5. An apparatus for cleaning toner particles from a moving surface comprising:

at least two brushes, a first brush and a second brush, each having a plurality of fibers extending outwardly therefrom;

a housing, defining an open ended chamber, said brushes being mounted movably in the chamber of said housing with said fibers extending outwardly from the open end of the chamber of said housing in contact with the surface to remove the toner particles therefrom;

means for detoning, including a first detoning means and a second detoning means, to remove the toner particles from said fibers removed from the surface; and means for removing the toner particles from said first detoning means toward said second detoning means.

6. An apparatus as recited in claim 5, wherein said removing means comprises:

a first removing means; and a second removing means, said second detoning means located upstream from said second removing means in a direction of motion of the surface.

7. An apparatus as recited in claim 6, wherein said first removing means directs the toner particles toward said second detoning means to provide lubrication thereon.

8. An apparatus as recited in claim 7, further comprising a baffle, located between the first detoning means and the second detoning means to prevent the toner particles, removed from said first detoning means, from falling back onto the brushes.

9. An apparatus as recited in claim 8, wherein said baffle guides the toner particles toward said second detoning means for lubrication thereon.

10. An apparatus as recited in claim 9, wherein said second removing means removes particles from said second detoning means.

11. An apparatus as recited in claim 10, wherein said first and second detoning means each comprise detoning rolls.

12. An apparatus as recited in claim 11, wherein said first removing means comprise scraper blades.

13. An apparatus as recited in claim 5, wherein said brushes are conductive.

14. An apparatus as recited in claim 7, further comprising means for propelling the toner particles from said first detoning means to said second detoning means.

15. An apparatus as recited in claim 14, wherein said propelling means is located between said first and second detoning means.

16. An apparatus for cleaning toner particles from a moving surface, comprising:

a brush, having a plurality of fibers extending outwardly therefrom;

a housing, defining an open ended chamber, said brush being mounted movably in the chamber of said housing with said fibers extending outwardly from the open end of the chamber of said housing in contact with the surface to remove the toner particles therefrom;

means for detoning, including a first detoning means and a second detoning means, to remove the toner particles from said fibers removed from the surface; and means for removing the toner particles from said first detoning means toward said second detoning means.

17. An apparatus as recited in claim 16, wherein said removing means comprises:

a first removing means; and a second removing means, said second detoning means located upstream from said second removing means in a direction of motion of the surface.

18. An apparatus as recited in claim 17, wherein said first removing means directs the toner particles toward said second detoning means to provide lubrication thereon.

19. An apparatus as recited in claim 18, further comprising a baffle, located between the first detoning means and the second detoning means to prevent the toner particles, removed from said first detoning means, from falling back onto the brush.

20. An apparatus as recited in claim 19, wherein said baffle guides the toner particles toward said second detoning means for lubrication thereon.

21. An apparatus as recited in claim 20, wherein said second removing means removes particles from said second detoning means.

22. An apparatus as recited in claim 21, wherein said first and second detoning means each comprise detoning rolls.

23. An apparatus as recited in claim 22, wherein said first removing means comprise scraper blades.

24. An apparatus as recited in claim 16, wherein said brush are conductive.

25. An apparatus as recited in claim 18, further comprising means for propelling the toner particles from said first detoning means to said second detoning means.

26. An apparatus as recited in claim 25, wherein said propelling means is located between said first and second detoning means.

* * * * *